United States Patent [19]

Egelhof

[11] 3,954,558

[45] May 4, 1976

[54] FEEDING DEVICE FOR PAPER MACHINES

[75] Inventor: Dieter Egelhof, Heidenheim (Brenz), Germany

[73] Assignee: J. M. Voith GmbH, Heidenheim, Germany

[22] Filed: July 11, 1974

[21] Appl. No.: 487,810

[30] Foreign Application Priority Data

July 13, 1973 Germany ..... 2335602

[52] U.S. Cl. ..... 162/336; 162/344; 162/347

[51] Int. Cl.[2] ..... D21F 1/06

[58] Field of Search ..... 162/336, 317, 214, 339, 162/344, 346, 347, 343

[56] References Cited

UNITED STATES PATENTS

| | | | |
|---|---|---|---|
| 2,506,678 | 5/1950 | Osgood | 162/347 |
| 3,661,702 | 5/1972 | Means | 162/336 X |
| 3,769,155 | 10/1973 | Schiel | 162/336 X |
| 3,846,230 | 11/1974 | Wahren et al. | 162/336 X |
| 3,853,695 | 12/1974 | Back et al. | 162/336 X |

OTHER PUBLICATIONS

Bratton et al., "The Flow Spreader," *The Paper Industry and Paper World*, Jan. 1943, pp. 1062, 1064, 1066.

*Primary Examiner*—S. Leon Bashore
*Assistant Examiner*—Marc L. Caroff
*Attorney, Agent, or Firm*—Michael J. Striker

[57] ABSTRACT

A feeding device to which a fibrous suspension is supplied by an input manifold includes a passage extending over the entire width of the forming wire to which the suspension is to be fed. The passage may be composed of several sections, any two consecutive sections including with one another an angle which increases in direction from the inlet to the outlet of the passage. The flow-through cross-sectional area of at least one of the sections may decrease in direction of the flow of the suspension, and the inlet cross-sectional area of any downstream section at most equals the outlet cross-sectional area of the preceding section. A microturbulent flow pattern is obtained throughout the passage so that deposition of the fibers on the walls bounding the passage and agglomeration thereof are prevented. The passage may be bounded by two independent portions of the feeding device and the flow-through cross-sectional area of the passage may be varied by changing the relative positions of the portions with attendant variation of the amount of suspension being fed to the wire.

8 Claims, 1 Drawing Figure

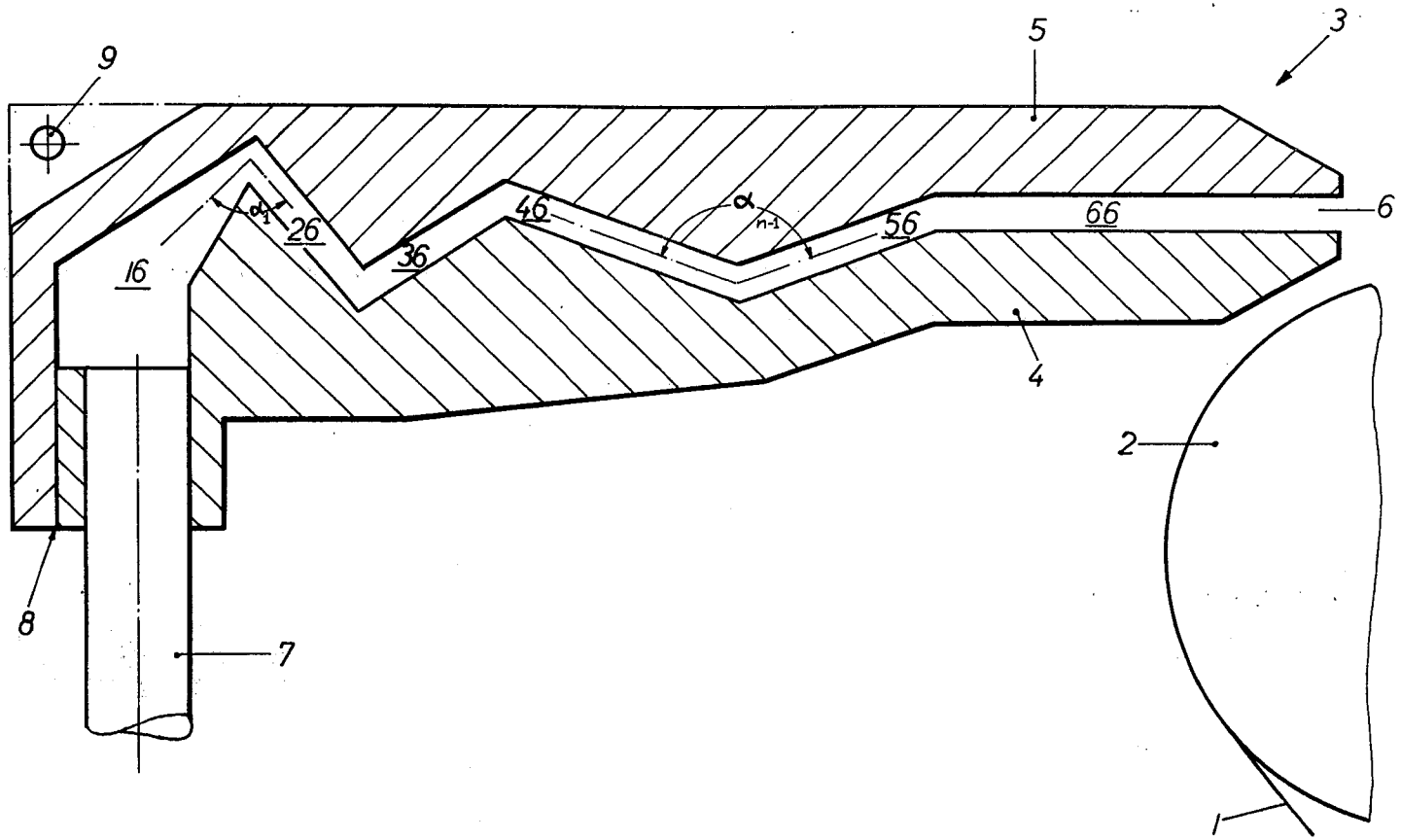
3
6
66
5
4
56
46
36
26
16
9
7
8
2
1

FEEDING DEVICE FOR PAPER MACHINES

BACKGROUND OF THE INVENTION

The present invention relates to a feeding device, particularly to a breast box to be used for feeding a fibrous suspension to the forming wire of a paper machine.

There are already known various feeding devices of the type under discussion in which the housing of the feeding device is provided with a passage which extends over the entire width of the forming wire to which the fibrous suspension is to be supplied. It is also already known to provide an input manifold which communicates with the passage and which introduces the fibrous suspension thereinto.

In such conventional devices —so-called breast boxes— attempts have been made to achieve as uniform and steady flow of the fibrous suspension as possible in order to prevent the fibers suspended in the carrier medium from forming agglomerations. However, the heretofore known devices are complex in construction and, consequently, expensive to manufacture, and a high dilution ratio of the suspension is needed for the devices to operate properly, which renders the subsequent removal of the carrier medium more difficult and the entire paper-manufacturing process more expensive.

SUMMARY OF THE INVENTION

It is a general object of the present invention to avoid the disadvantages of the prior art.

More particularly, it is an object of the present invention to provide a feeding device which is inexpensive to manufacture and to operate, and which is reliable nevertheless.

It is a further object of the present invention to provide a feeding device for feeding a fibrous suspension to a forming wire of a paper machine which may be operated at a low dilution ratio.

It is a concomittant object of the present invention to provide a feeding device for feeding a fibrous suspension to a forming wire of a paper machine in which formation of fiber agglomerations is prevented.

It is still another object of the present invention to provide a feeding device for feeding a fibrous suspension to a forming wire of a paper machine in which the amount of the fibrous suspension being fed to the forming wire may be varied by varying the flow-through cross-sectional area of the feeding device.

In pursuance of the above objects and others which will become apparent hereinafter, one feature of the present invention resides, in a feeding device comprising a housing defining an interior passage, in the provision of the interior passage as a multi-section passage, the respective sections constituting the passage, which include an inlet section and an outlet section, having inlets and outlets, the inlet of the respective section communicating with the outlet of the immediately preceding section so that the sections are arranged seriatim in direction from the inlet section to the outlet section, and the respective immediately consecutive sections enclosing an angle with one another, the fibrous suspension to be fed to the forming wire being introduced into the inlet section and leaving the passage through the outlet section. According to an additional feature of the invention, the flow-through cross-sectional area of at least one of the sections decreases in direction from the inlet to the outlet thereof so that the speed of flow of the fibrous suspension increases in the same direction.

As a result of the above-mentioned multi-sectional arrangement of the passage, and of the mutually inclined arrangement of the respective sections, Taylor's eddies are generated in the region of merger of the two immediately consecutive sections of the passage as a result of the change of direction of the flow, so that a very high microturbulence is obtained in the fibrous suspension, which microturbulence is maintained in the fibrous suspension and proceeds with the same toward the outlet due to the fact that the flow-through cross-section of at least one of the sections decreases in direction from the inlet to the outlet thereof with attendant increase in the speed of flow of the fibrous suspension. As a result of this microturbulence in the fibrous suspension throughout the passage, the formation of fiber agglomerations in the fibrous suspension is prevented even at a high fiber concentration ratio, that is at a low dilution ratio.

Experience has shown that it is very advantageous if the flow-through cross-section of the outlet of the respective section equals the flow-through cross-sectional area of the immediately consecutive downstream section, or if it exceeds the same. When such an arrangement is provided in accordance with the invention, advantageous flow and microturbulence-maintaining conditions are achieved throughout the passage. The reason for this is that, in addition to the energy losses due to the diversion of the flow by the mutually inclined arrangement of the sections of the passage, additional energy losses are caused by the relative dimensions of the outlets and the inlets of the respective sections, the occurence of these energy losses resulting in an improvement of the uniformity of distribution of the flow velocity throughout the cross-section of the passage and, because of the microturbulence in the fibrous suspension, the formation of fiber deposits in the region of merger of the various sections and the formation of fiber agglomerations in the fibrous suspension are prevented.

An advantageous and currently preferred embodiment of the present invention is that the passage is defined by bounding surfaces provided on two different parts of the housing of the feeding device, and that the two parts are mounted for movement with respect to one another. Advantageously, one of the parts is stationary except for the movement toward and away from the forming wire, and the other part is mounted on the one part so as to share its above-mentioned movement, but also for an independent shifting or pivoting movement with respect thereto. By means of this arrangement, it is achieved that the flow-through cross-sectional area of the passage can be accomodated to the quantity or the dilution ratio of the fibrous suspension which is to be supplied to the forming wire in any given instance.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE of the drawing is a longitudinal sectional view of the currently preferred embodiment of the invention.

DETAILED DESCRIPTION OF THE PREFERRED EMBODIMENTS

Discussing now the drawing in detail, it may be seen that the single FIGURE illustrates the feeding device according to the invention and some of the elements of the paper machine with which it cooperates. The reference numeral 1 designates a forming wire of a conventional Fourdrinier machine which is conducted along the circumference of a breast roll 2. A feeding device or a breast box, which is designated in toto with the reference numeral 3, extends over the entire width of the paper machine, that is over the entire width of the forming wire 1. The feeding device 3 includes a lower part 4 and an upper part 5, these two parts of the feeding device 3 defining with one another a passage 6 which also extends over the entire width of the forming wire 1.

The fibrous suspension which is to be supplied to the forming wire 1 is introduced into the passage 6 via a plurality of distributing pipes 7, which may be parts of an input manifold, and of which only one is illustrated. The passage is constituted by a plurality of sections, including an inlet section 16, an outlet section 66 and intermediate sections 26, 36, 46 and 56, each two immediately consecutive sections enclosing with one another an angle $\alpha_1$ to $\alpha_n$ in the direction from the inlet section 16 to the outlet section 66, only the angles $\alpha_1$ and $\alpha_{n-1}$ being illustrated. In the currently preferred embodiment of the invention, the angles between the respective sections 16, 26, 36, 46, 56 and 66 increase in the direction from the inlet section 16 to the outlet section 66, the angle between the sections 16 and 26 being the smallest and amounting to approximately 70°, the angle between the sections 56 and 66 being the largest and amounting to substantially 170°. Each of the sections 16, 26, 36, 46, 56 and 66 has an inlet and an outlet, and the bounding walls defining at least one of the sections of the passage 6 may converge in the direction from the inlet to the outlet of the section, so that the flow-through cross-sectional area of the respective section of the passage decreases in the direction of flow of the fibrous suspension. In an advantageous embodiment of the invention, all of the bounding walls defining the respective sections converge in the above-mentioned direction, and the flow-through cross-section of the outlet of the respective section is equal to or exceeds the flow-through cross-sectional area of the immediately consecutive section with which it communicates, so that a reduction of the flow-through cross-sectional area of the passage 6 is achieved from the inlet section 16 to the outlet section 66 with attendant increase in the speed of flow of the fibrous suspension in the same direction.

The lower part 4 of the feeding device 3 is stationary but for the adjustment displacement thereof with respect to the forming wire 1 in order to orient and direct the stream of the fibrous suspension ejected from the outlet section 66 on the forming wire 1. On the other hand, the upper part 5 is mounted on the lower part 4 so as to share its adjustment displacement, but, in addition thereto, it is also mounted for displacement relative to the lower part 4. In the illustrated embodiment of the invention, a bearing 8 is provided between the upper part 5 and the lower part 4 of the feeding device 3, and the upper part 5 is mounted in any conventional manner, which needs no detailed discussion, on the lower part 4 for displacement upwardly and downwardly as seen in the FIGURE In this manner, an uniform adjustment of the flow-through cross-section of all sections 16, 26, 36, 46, 56 and 66 may be obtained by displacing the upper part 5 with respect to the lower part 4 with attendant accomodation of the cross-section of the passage 6 to the given requirements and to the amount of the fibrous suspension passing therethrough per unit of time and at a predetermined advantageous flow speed.

The sole FIGURE also shows, in phantom lines, a modified embodiment of the invention, in which a pivot 9 connects the upper part 5 to the lower part 4 and in which the adjustment of the relative position of the upper part 5 with respect to the lower part 4 is achieved in a pivoting manner, whereby the flow-through cross-sectional area of the passage 6 is also adjusted so as to correspond to the given requirements.

The drawing shows that the bounding walls defining each two immediately consecutive sections merge with one another and form a corner with one another. However, according to an additional feature of the invention, the regions of merger of these walls may be rounded off so as to provide for a smooth transition from one bounding surface to the immediately consecutive one. It is currently preferred that both the outward and the inward regions of merger when considered in the direction of flow be rounded off so as to avoid the danger that the fibers may deposit or agglomerate in such regions.

It will be understood that each of the elements described above, or two or more together, may also find a useful application in other types of constructions differing from the types described above.

While the invention has been illustrated and described as embodied in a feeding device for paper machines, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended claims:

1. A feeding device, particularly for feeding a fibrous suspension to a forming wire of a paper machine, comprising a housing defining an interior passage consisting of a plurality of consecutive sections including an inlet section and an outlet section, each of said sections having an inlet and an outlet directly communicating with the inlet of the immediately following section, the flow-through cross-sectional area of at least one of said sections decreasing in direction from said inlet to said outlet thereof, each two immediately consecutive sections enclosing an angle with one another, said angle lying substantially between 70° and 170° and increasing from section to section toward said outlet section; and means for supplying the suspension to the inlet of said inlet section.

2. A device for conducting a fluid having at least two components, particularly for feeding a fibrous suspension to a forming wire of a paper machine, comprising means for supplying the fluid; and a housing defining an interior passage for conducting the fluid in a tortuous flow path, said passage having an inlet end communicating with said supply means, and an outlet end for discharging the fluid from said passage, said passage including a plurality of consecutive sections each having an inlet and an outlet directly communicating with the inlet of the immediately following section, each two immediately consecutive sections enclosing an angle with one another so that regions of microturbulence are formed in the fluid at said inlets of said following sections due to changes in flow direction, in which regions the components of the fluid are admixed whereby at least one of the components is prevented from agglomerating, said angle lying substantially between 70° and 170° and increasing from section to section in said flow direction, and the flow-through cross-sectional area of at least one of said sections decreasing in direction from said inlet to said outlet thereof to thereby increase the velocity of flow of the fluid between said inlet and said outlet of said at least one section.

3. A feeding device as defined in claim 1, wherein the flow-through cross-sectional area of the inlet of a respective section substantially corresponds to the flow-through cross-section of the outlet of the immediately preceding section.

4. A feeding device as defined in claim 1, wherein the flow-through cross-sectional area of the outlet of a respective section exceeds the flow-through cross-sectional area of the inlet of the immediately following section.

5. A feeding device as defined in claim 1, wherein adjacent walls defining said immediately consecutive sections merge with one another; and wherein the regions of merger are rounded-off.

6. A feeding device as defined in claim 1, wherein said housing has a first portion bounding said passage from one side thereof, and a second portion bounding said passage from the opposite side thereof; and wherein said housing portions are mounted for relative movement with respect to one another for adjusting the flow-through cross-sectional area of said passage.

7. A feeding device as defined in claim 6, wherein said first portion is stationary; and further comprising a bearing interposed between said first and second portions, and means for effecting parallel movement of said second section with respect to said first section.

8. A feeding device as defined in claim 6, wherein said first and second portions include a plurality of surface portions, the associated mutually facing surface portions of said first and second portions defining with one another said plurality of consecutive passage sections, the consecutive ones of said surface portions enclosing with one another an angle in direction from said inlet section to said outlet section.

* * * * *